US007992582B2

(12) United States Patent
Kupferman

(10) Patent No.: US 7,992,582 B2
(45) Date of Patent: Aug. 9, 2011

(54) UMBRELLA AND UMBRELLA CANOPY

(76) Inventor: Glenn Kupferman, Lake Worth, FL (US)

( * ) Notice: Subject to any disclaimer, the term of this patent is extended or adjusted under 35 U.S.C. 154(b) by 97 days.

(21) Appl. No.: 12/351,369

(22) Filed: Jan. 9, 2009

(65) Prior Publication Data

US 2009/0235965 A1 Sep. 24, 2009

Related U.S. Application Data

(63) Continuation-in-part of application No. 11/717,445, filed on Mar. 12, 2007, now abandoned.

(51) Int. Cl.
*A45B 25/22* (2006.01)
*A45B 25/18* (2006.01)

(52) U.S. Cl. ..... 135/33.7; 135/33.2

(58) Field of Classification Search ..... 135/15.1, 135/16, 33.2, 33.7, 33.71, 98; D3/5–6, 10; 362/102
See application file for complete search history.

(56) References Cited

U.S. PATENT DOCUMENTS

| | | | | | |
|---|---|---|---|---|---|
| 635,811 | A * | 10/1899 | Rothschild | 135/33.41 |
| 3,456,661 | A * | 7/1969 | Farley | 135/33.7 |
| 5,368,055 | A * | 11/1994 | Johnson et al. | 135/33.7 |
| 5,438,779 | A * | 8/1995 | Suarez | 40/317 |
| 5,487,401 | A * | 1/1996 | Johnson et al. | 135/33.7 |
| 5,890,506 | A * | 4/1999 | Kupferman | 135/33.2 |
| 6,095,171 | A * | 8/2000 | Lin et al. | 135/33.7 |
| 6,401,737 | B1 * | 6/2002 | Kloor, III | 135/33.7 |
| 6,470,899 | B2 * | 10/2002 | Johnson et al. | 135/29 |
| D475,525 | S * | 6/2003 | You | D3/5 |
| 6,705,334 | B2 * | 3/2004 | Altobelli | 135/16 |
| D509,954 | S * | 9/2005 | Waltz | D3/5 |
| 2003/0159748 | A1 * | 8/2003 | Tung | 139/117 |
| 2006/0289045 | A1 * | 12/2006 | Amador | 135/16 |

FOREIGN PATENT DOCUMENTS

| | | | |
|---|---|---|---|
| DE | 4115467 | A1 * | 9/1992 |
| FR | 2898779 | A1 * | 9/2007 |

* cited by examiner

*Primary Examiner* — Winnie Yip
(74) *Attorney, Agent, or Firm* — Fay Kaplun & Marcin, LLP

(57) ABSTRACT

An umbrella having a central shaft, a spindle slidably disposed on the shaft, a first plurality of radially extending ribs hingedly attached to the shaft, a second plurality of radially extending ribs secured at first ends thereof to the spindle and secured at second ends thereof to respective ones of the first plurality of ribs and an umbrella canopy supported by the first plurality of ribs, the canopy secured to the first ends of the first plurality of ribs adjacent to the second end of the central shaft and secured to the second ends of the second plurality of ribs at an outer perimeter of the canopy, wherein the canopy includes one or more single-canopy umbrella panels, and one or more double-canopy umbrella panels and wherein the double-canopy umbrella panels includes an upper canopy and a lower canopy, and wherein only the lower canopy is secured directly to the ribs.

16 Claims, 13 Drawing Sheets

UMBRELLA AND UMBRELLA CANOPY

PRIORITY CLAIM/INCORPORATION BY REFERENCE

The present application claims priority as a continuation-in-part application from U.S. patent application Ser. No. 11/717,445 filed on Mar. 12, 2007 now abandoned and entitled "Umbrella and Umbrella Canopy." This previous application is incorporated by reference, in its entirety, herein.

BACKGROUND INFORMATION

Double-canopy umbrellas present a significant improvement over traditional single-canopy umbrellas by allowing the flow of air from below the canopy to above (and vice versa), preventing inversion or collapse due to gusts of wind. However, double-canopy umbrellas may be structurally weaker, and further contain less surface area on which logos or other graphics may be printed.

SUMMARY OF THE INVENTION

An umbrella having a central shaft adapted to be grasped by a user at a first end thereof and having a second end, a spindle slidably disposed on the shaft and movable between a first position adjacent to the first end of the shaft and a second position adjacent to the second end of the shaft, a first plurality of radially extending ribs hingedly attached at first ends thereof to the second end of the shaft and terminating at second ends, a second plurality of radially extending ribs secured at first ends thereof hingedly to the spindle and secured at second ends thereof to respective ones of the first plurality of ribs and an umbrella canopy supported by the first plurality of ribs, the canopy secured to the first ends of the first plurality of ribs adjacent to the second end of the central shaft and secured to the second ends of the second plurality of ribs at an outer perimeter of the canopy, wherein the canopy includes one or more single-canopy umbrella panels, and one or more double-canopy umbrella panels and wherein the double-canopy umbrella panels includes an upper canopy and a lower canopy, and wherein only the lower canopy is secured directly to the ribs.

An umbrella canopy having a plurality of ribs, one or more single-canopy panels; and one or more double-canopy panels, wherein the double-canopy panels comprises and upper canopy and a lower canopy, and wherein the lower canopy is secured to at least one of the ribs in a plurality of locations and the upper canopy is only secured at a first end to the lower canopy.

An umbrella canopy having a plurality of ribs, one or more double-canopy panels, wherein the double-canopy panels comprises and upper canopy and a lower canopy, and wherein the lower canopy is secured to at least one of the ribs in a plurality of locations and the upper canopy is only secured at a first end to the lower canopy.

DETAILED DESCRIPTION

Figure 1A:
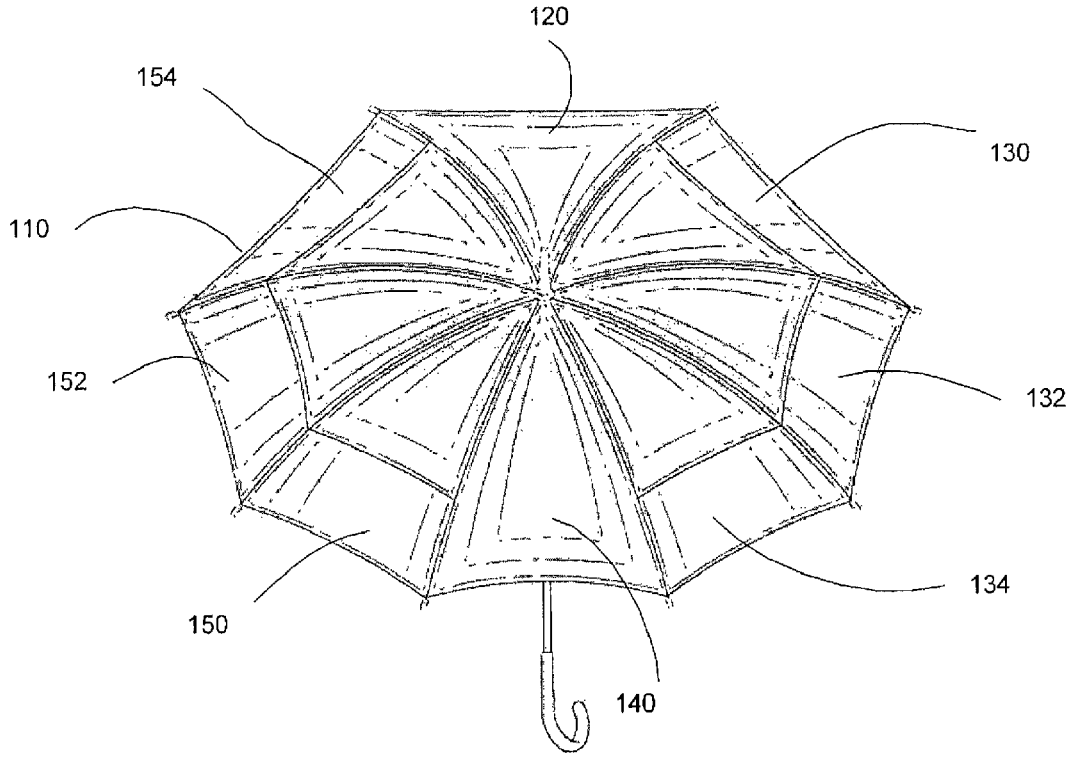
FIGS. 1*a* and 1*b* show top and bottom views of a first exemplary umbrella canopy according to the present invention.

The exemplary embodiments of the present invention provide an improved hybrid umbrella canopy that combines advantageous aspects of both single-canopy and double-canopy umbrellas. The present invention may be further understood with reference to the following description and the appended drawings, wherein like elements are referred to with the same reference numerals.

An exemplary double-canopy umbrella is designed around a central shaft with a handle at a first end. A plurality of radially-extending ribs are hingedly attached at a second end of the shaft. The canopy is comprised of a flexible, foldable, waterproof covering (e.g., a waterproof cloth natural or synthetic covering, such as nylon) disposed over the plurality of ribs. The canopy comprises two separate canopy portions, a lower portion and an upper portion, which at least partially covers the lower portion. (In contrast, the canopy of a single-canopy umbrella includes only one canopy portion). Each canopy portion comprises a plurality of substantially triangular panels ("gores"), which are sewn together along lines overlying the ribs to form the canopy portions. It should be noted that the words "gores" and "panels" will be used interchangeably throughout this disclosure. The gores are secured to the ribs at suitable points (in particular, at each end of the ribs). Additionally, the gores may be, and preferably are, secured to the ribs with suitable stitching or bar tacking at intermediary points along the ribs.

The lower canopy portion comprising a plurality of gores comprises, when sewn together, a substantially air intransmissible annular perimeter portion, an air transmissible intermediate annular opening, and a central upper substantially air intransmissible portion. By "substantially air intransmissible," it is meant that the material presents a barrier to wind gusts (i.e., does not allow wind gusts to pass through), even though the material may "breathe" somewhat, or allow some air to permeate through. Conversely, by "substantially air transmissible," it is meant that wind gusts can pass through. The substantially air transmissible intermediate opening may be, for example, a flexible mesh material or an air intransmissible material with openings (in the shape of, e.g., holes, slits, or teardrops). The substantially air transmissible intermediate opening is sewn to the material of the perimeter portion along a joining line, and is sewn to the material of the central portion at a joining line. Accordingly, each gore comprises an upper triangular shaped member, an air transmissible member that is essentially formed in the shape of a truncated cone, and a lower portion that is also essentially formed in the shape of a truncated cone. When the plurality of gores is sewn together along their radial edges, the lower canopy portion is formed.

The air transmissible portion provides an escape route for air gusts impinging on the concave lower surface of the umbrella when it is in a deployed state. The air transmissible portion also provides strength to the entire lower canopy portion, helping to keep the lower canopy portion taut.

The upper canopy portion is disposed over the central portion of the lower canopy, the air transmissible portion of the lower canopy, and an overlapped segment of the outer portion of the lower canopy. The overlap prevents rainwater from falling through the air transmissible portion. The upper canopy is secured to the lower canopy along the outer perimeter of the upper canopy portion, and is further secured to the central shaft. The upper canopy, like the lower canopy, comprises a plurality of sewn together triangular shaped gores.

The umbrella typically includes a spindle, mounted on the central shaft, to which a second set of radially extending erecting ribs are hingedly attached. The erecting ribs are attached to respective upper ribs by suitable hinges approximately at the mid-section of the upper ribs. The spindle is slidable on the central shaft, so that the umbrella may be moved to and from its deployed state. The spindle is moved upward from a position adjacent the handle to deploy the umbrella. When the spindle is moved upward, the erecting ribs move the upper ribs from an undeployed position to a deployed position, thereby erecting the umbrella canopy and giving the umbrella a convex upper surface and concave lower surface. A more complete description of an exemplary double canopy umbrella may be found in U.S. Pat. No. 5,890,536, entitled "Umbrella and Umbrella Canopy" and issued Apr. 6, 1999.

Figure 16:
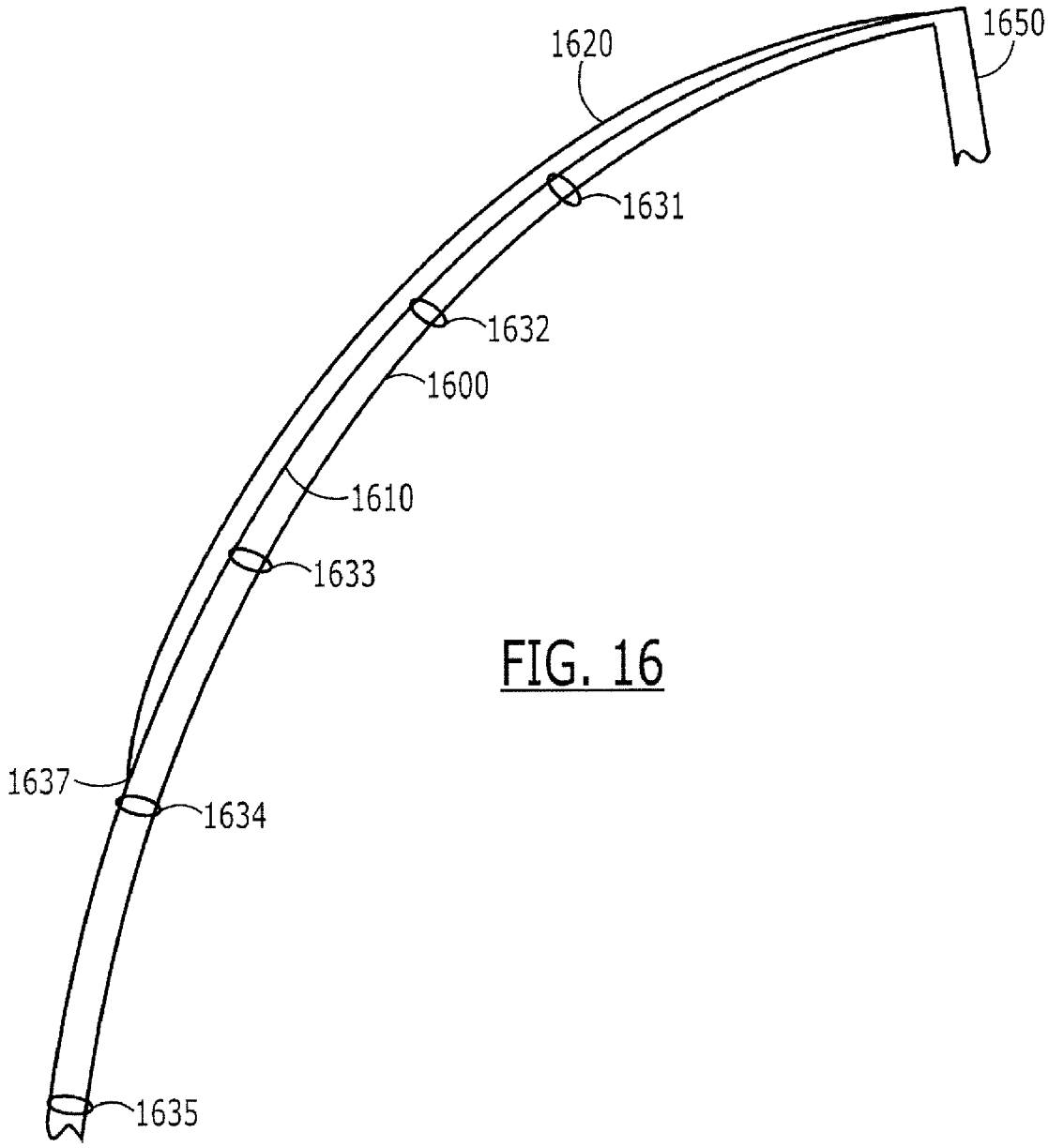
FIG. 16 shows a cross-sectional view of an exemplary umbrella that includes a central shaft, a rib, a lower canopy and an upper canopy.

FIG. 16 shows a cross-sectional view of an exemplary umbrella that includes a central shaft 1650, a single rib 1600, a lower canopy 1610 and an upper canopy 1620. As described previously, a first end of each of the rib 1600, the lower canopy 1610 and the upper canopy 1620 are secured to the central shaft 1650. The lower canopy 1610 that includes the air transmissible portion is secured to the rib 1600 by fastening arrangements 1631-1635 at a plurality of locations. It should be noted that the securing of the lower canopy 1610 to the rib 1600 at five locations is only exemplary and that more or less securing locations may be used based on any number of factors such as the size of the umbrella, the thickness and/or weight of the material used to construct the lower canopy 1610, etc. In this exemplary embodiment, the fastening arrangements 1631-1635 are fabric loops constructed of the same material as an air intransmissible portion of the lower canopy 1610. A first end of the fabric loop is sewn to the lower canopy 1610 while the second end is looped around the rib 1600 and then the second end of the loop is also sewn to the lower canopy 1610, thereby securing the lower canopy 1610 to the rib 1600. It is noted that the fabric loops 1631-1635 having different sizes as shown in FIG. 16 is only exemplary. It is also noted the in the area of the rib 1600, two separate panels of lower canopy portion may be joined. Thus, the first end of the loop may be sewn into a first lower canopy portion and the second end of the loop may be sewn into a second lower canopy portion. In addition, the two ends of the loop may be sewn into a location where the first and second lower canopy portion overlap. It is further noted that using loops made of the same fabric as the lower canopy as the fastening arrangement is only exemplary. Other materials such as reinforced string, etc. may be used. Also, the fastening arrangement do not need to be loops, but may be any structure that secures the lower canopy 1610 to the rib 1600, such as a loop and hook type fastener, a rivet, etc.

FIG. 16 also shows the upper canopy 1620 being secured to the lower canopy 1610 at location 1637. In this exemplary embodiment, the upper canopy 1620 is secured substantially at a second end of the upper canopy 1620 opposite the central shaft 1650 to the lower canopy 1610. It is noted that the upper canopy 1620 is secured only to the central shaft 1650 at the first end and to the lower canopy 1610 at the second end. The upper canopy 1620 is not secured at multiple locations to the lower canopy 1610 to allow for the largest quantity of air to flow through the double canopy arrangement. In addition, the upper canopy 1620 is not directly secured to the rib 1600 so that additional force is not applied to the rib 1600 that may cause the umbrella to invert.

Those skilled in the art will understand that the above is only one exemplary construction of a double canopy umbrella. Other types of double canopy umbrellas, including the manners of construction of such umbrellas, may exist. The present invention is not limited to any specific type of double or single canopy for an umbrella, but may be implemented using any type.

Figure 1B:
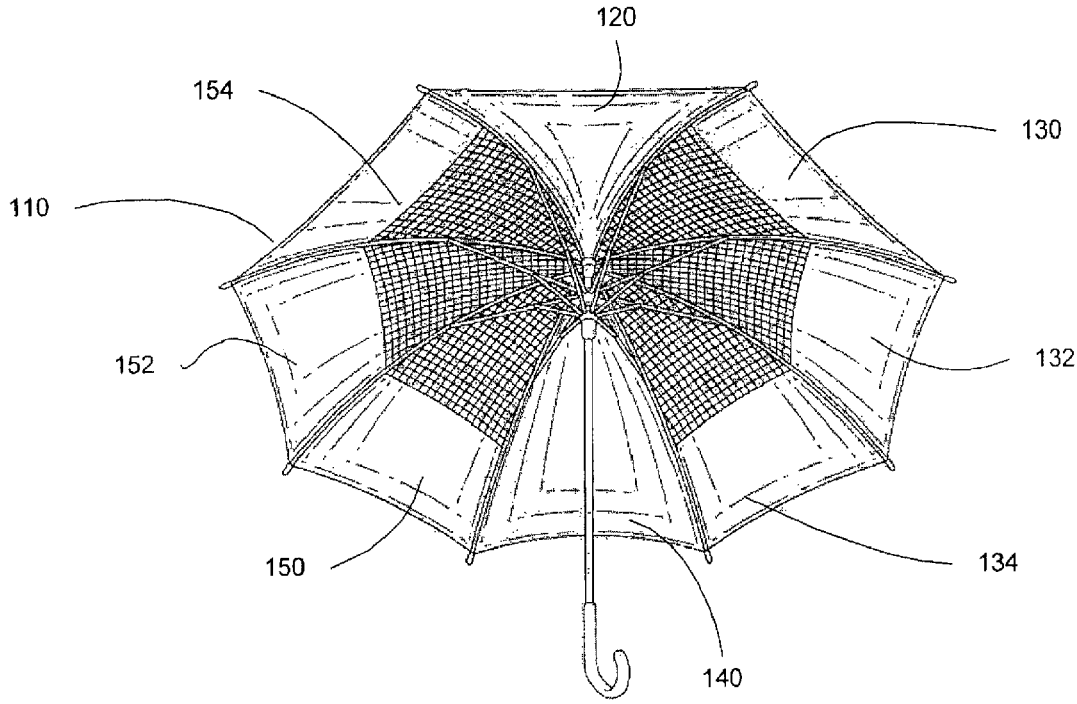

The exemplary embodiments of the present invention combine one or more double-canopy gores and one or more single-canopy gores (or panels). Construction of each individual panel and attachment of the panels to one another and to the ribs may be substantially as discussed above, or may be accomplished by any other manner of constructing single or double canopy umbrellas. FIG. 1*a* illustrates a top view of a first exemplary embodiment 110 of an umbrella canopy according to the present invention. The first exemplary embodiment 110 includes a single-canopy panel 120, three contiguous double-canopy panels 130, 132 and 134, a second single-canopy panel 140, and a second set of three contiguous double-canopy panels 150, 152 and 154. FIG. 1*b* shows a bottom view of the same first exemplary embodiment 110.

Figure 11A:
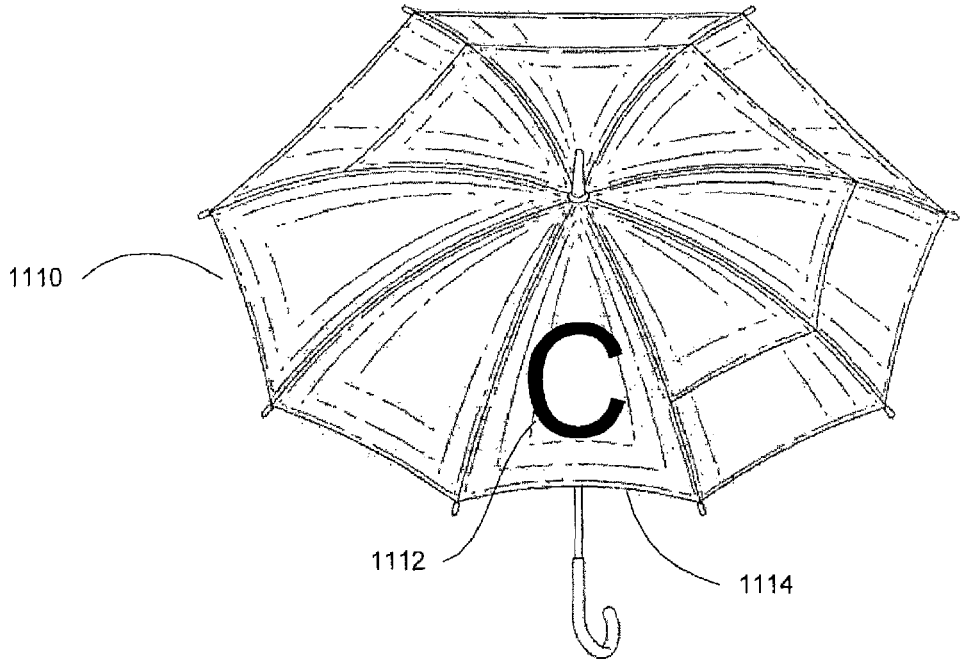
FIGS. 11*a* and 11*b* show logos printed on single-canopy and double-canopy panels of substantially identically sized umbrella canopies.
Figure 11B:
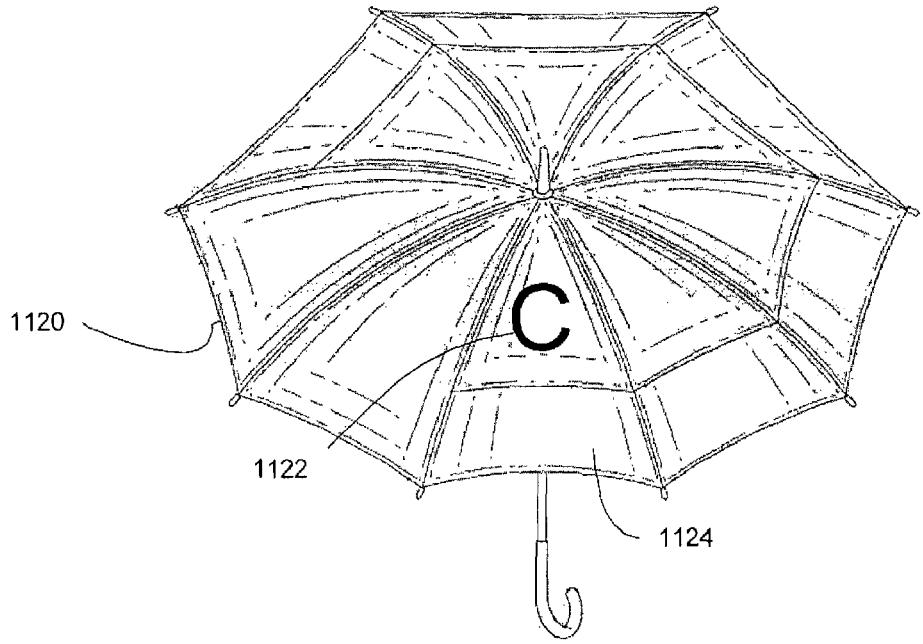

The combined use of both single-canopy and double-canopy panels results in a hybrid umbrella canopy possessing many of the advantages of both single-canopy and double-canopy umbrellas. The single-double hybrid canopy possesses the main advantage of a double-canopy umbrella, providing ventilation so as to minimize the effect of gusts of wind on the umbrella. Additionally, by incorporating one or more single-canopy panels, a single-double hybrid canopy may provide greater structural strength than a standard double-canopy umbrella. Further, the use of single-canopy panels enables the printing of larger graphics (e.g., corporate logos, university affinity logos, etc.); FIGS. 11*a* and 11*b* illustrate this feature. FIG. 11*a* shows an umbrella canopy 1110 with a graphic 1112 printed on a single-canopy panel 1114. FIG. 11*b* shows comparably-sized umbrella canopy 1120 with a graphic 1122 printed on a double-canopy panel 1124. As is apparent, the use of single-canopy panels allows the printing of larger graphics on a comparably-sized umbrella.

Those of skill in the art will understand that the exemplary hybrid umbrella canopy described above may be implemented using any standard umbrella structure known in the art. The central shaft and ribs may be structured as described for the exemplary double-canopy umbrella above or in any other manner. The umbrella may be self-opening or may have a spindle that is adapted to be manually moved along the central shaft by the user. The double-canopy panels may comprise a central air-transmissible mesh portion, or alternatively may comprise a central portion comprising an air-intransmissible material (e.g., nylon) that has perforations to permit the flow of air through the canopy. In such an embodiment, the perforations may be of any shape and size suitable to permit the flow of air (e.g., linear slits, curvilinear slits, circular perforations, ovate perforations, teardrop-shaped perforations, etc.).

Figure 2A:
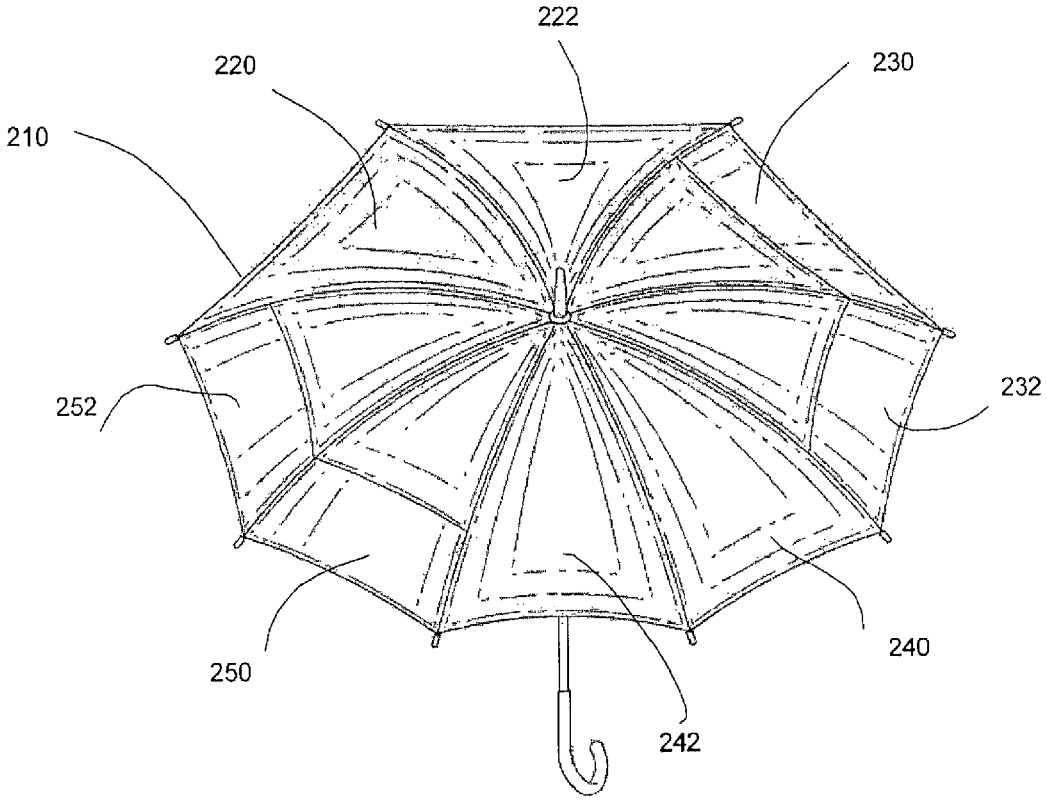
FIGS. 2*a* and 2*b* show top and bottom views of a second exemplary umbrella canopy according to the present invention.
Figure 2B:
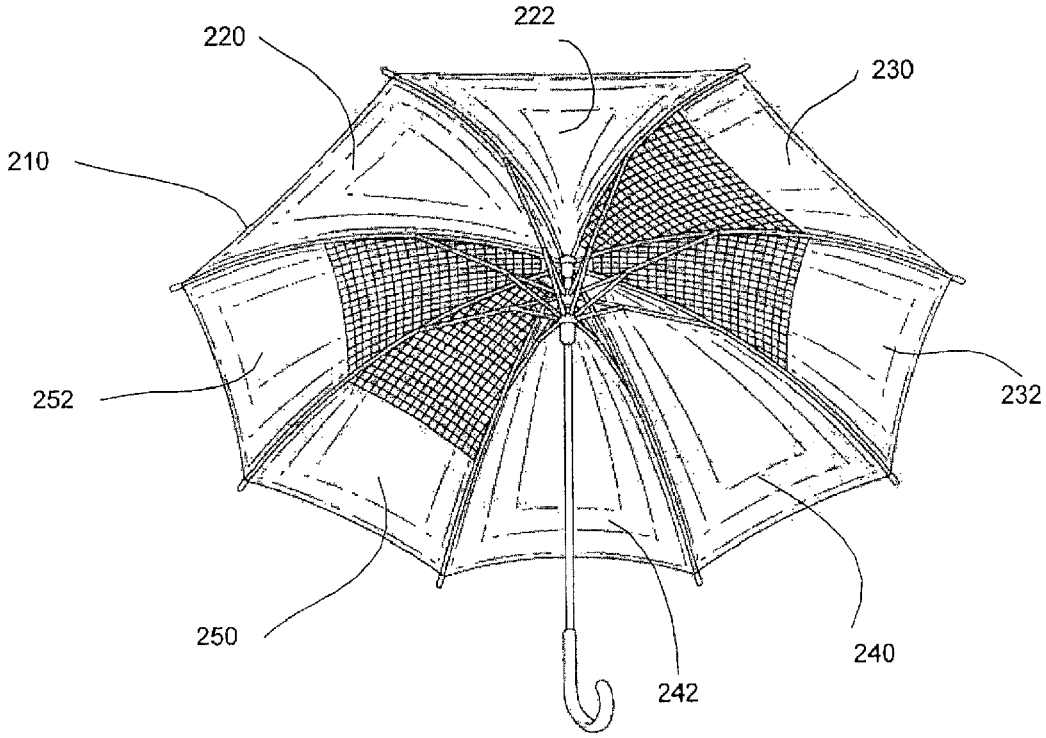

FIG. 2*a* illustrates a top view of a second exemplary embodiment 210 of an umbrella canopy according to the present invention. The second exemplary embodiment 210 includes two contiguous single-canopy panels 220 and 222, two contiguous double-canopy panels 230 and 232, a second set of two contiguous single-canopy panels 240 and 242, and a second set of two contiguous double-canopy panels 250 and 252. FIG. 2*b* shows a bottom view of the same second exemplary embodiment 210.

Figure 3A:
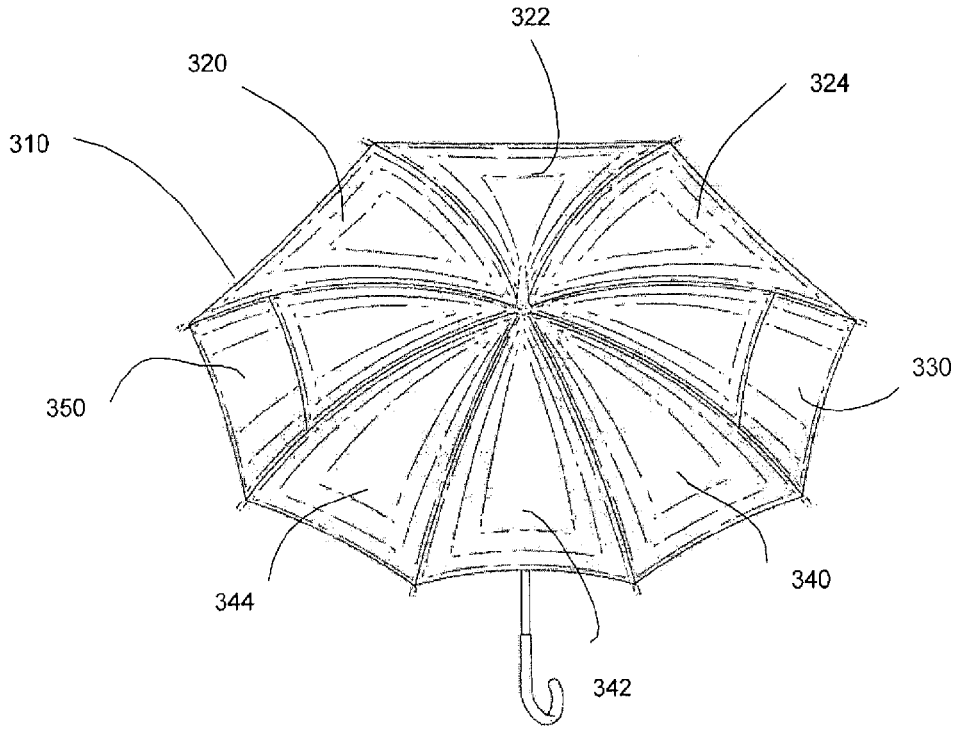
FIGS. 3*a* and 3*b* show top and bottom views of a third exemplary umbrella canopy according to the present invention.
Figure 3B:
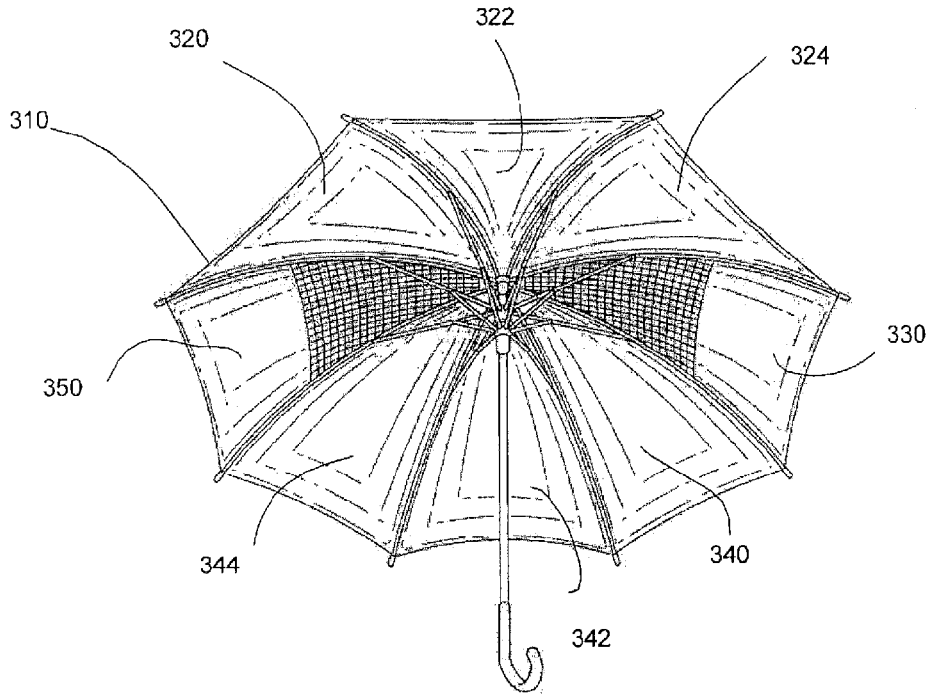

FIG. 3*a* illustrates a top view of a third exemplary embodiment 310 of an umbrella canopy according to the present invention. The third exemplary embodiment 310 includes a set of three contiguous single-canopy panels 320, 322 and 324, a double-canopy panel 330, another set of three contiguous single-canopy panels 340, 342, 344, and a second double-canopy panel 350. FIG. 3*b* shows a bottom view of the same third exemplary embodiment 310.

Figure 4A:
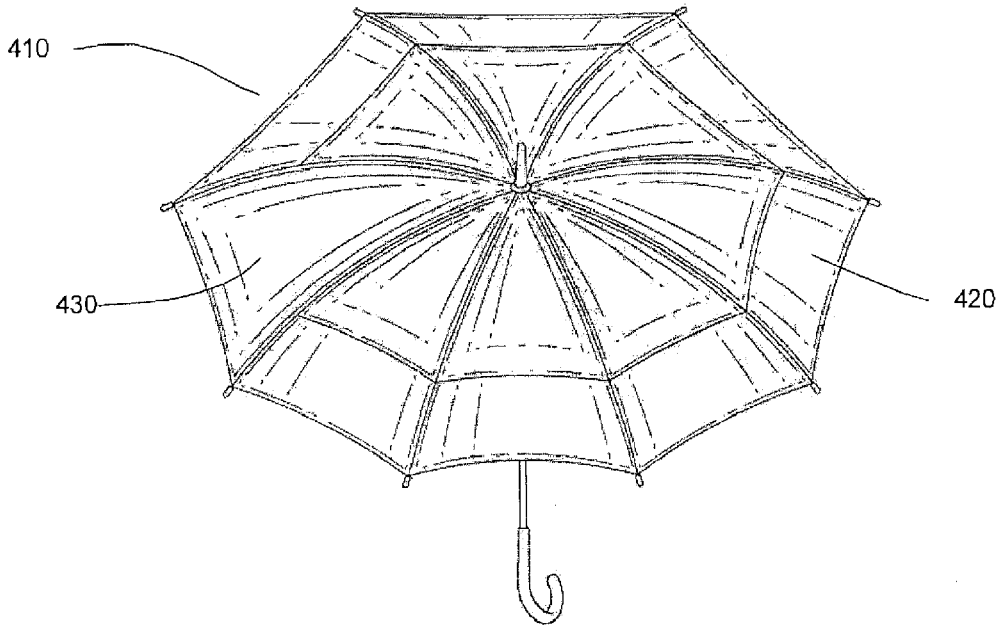
FIGS. 4*a* and 4*b* show top and bottom views of a fourth exemplary umbrella canopy according to the present invention.
Figure 4B:
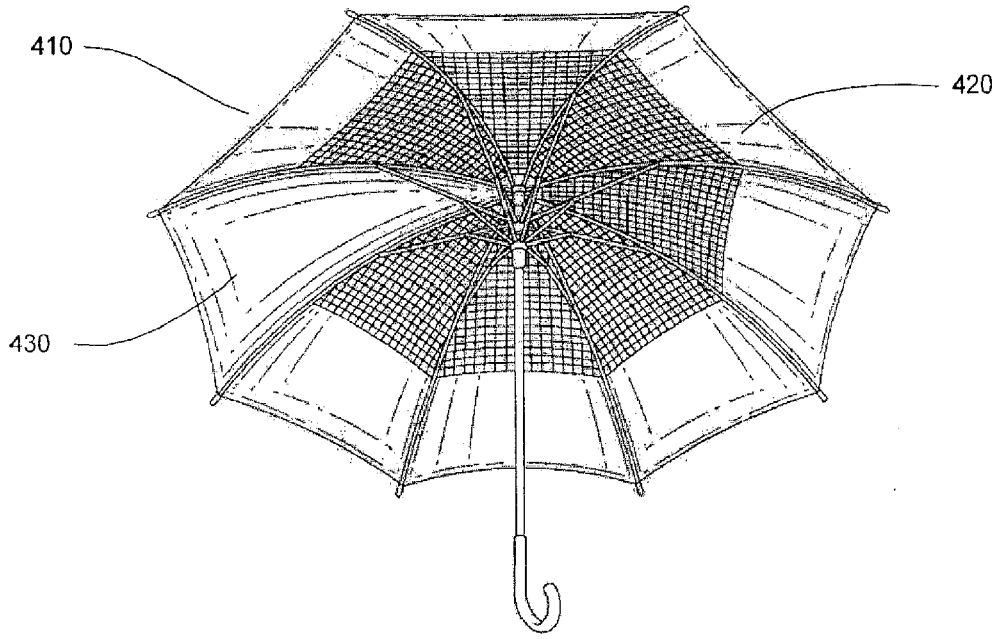

FIG. 4*a* illustrates a top view of a fourth exemplary embodiment 410 of an umbrella canopy according to the present invention. The fourth exemplary embodiment 410 includes seven contiguous double-canopy panels 420 and one single-canopy panel 430. FIG. 4*b* shows a bottom view of the same fourth exemplary embodiment 410.

Figure 5A:
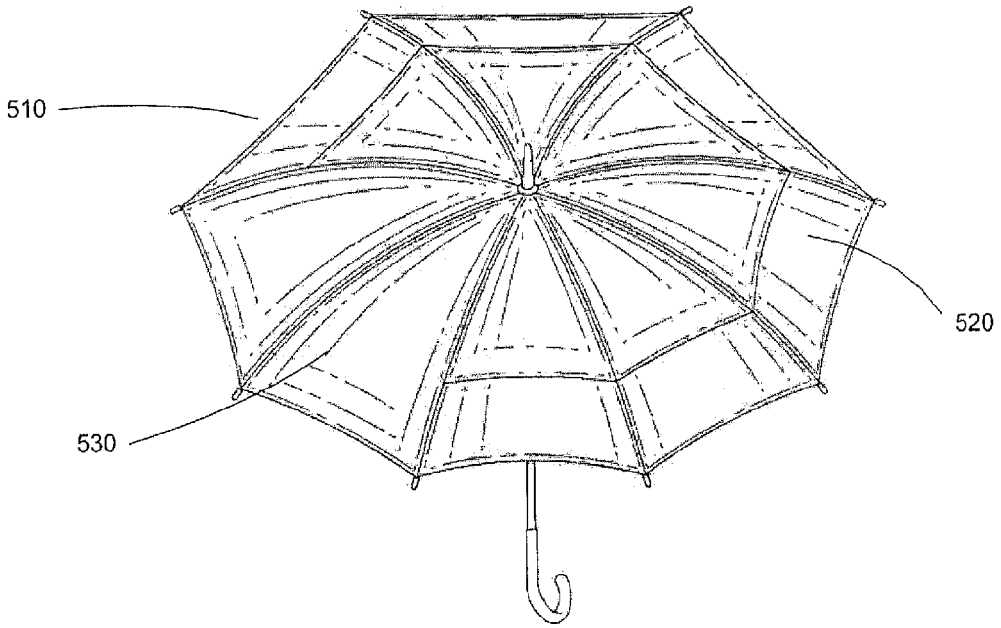
FIGS. 5*a* and 5*b* show top and bottom views of a fifth exemplary umbrella canopy according to the present invention.
Figure 5B:
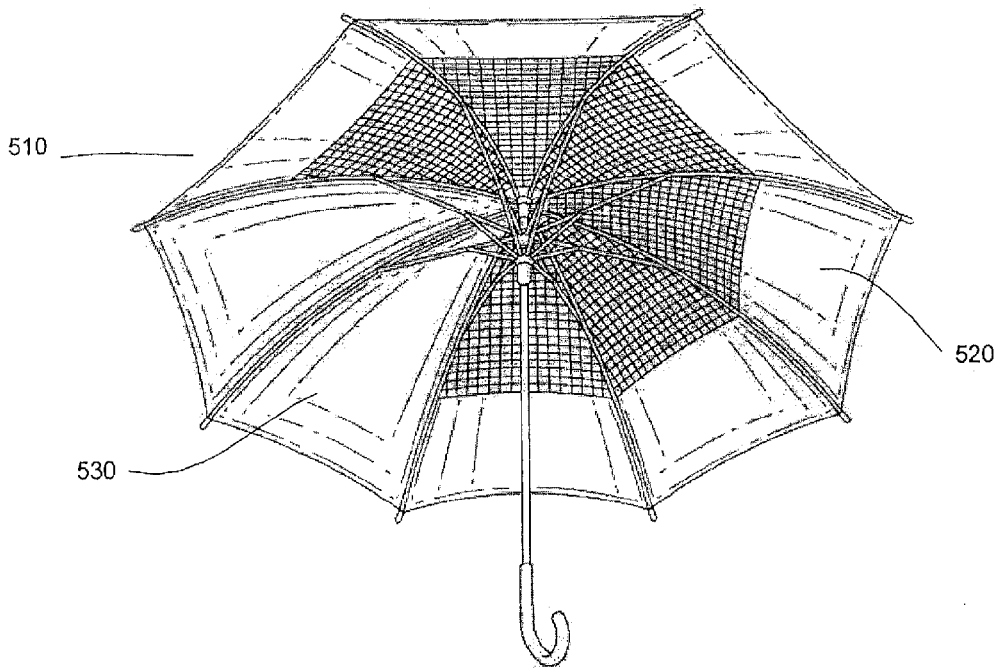

FIG. 5*a* illustrates a top view of a fifth exemplary embodiment 510 of an umbrella canopy according to the present invention. The fifth exemplary embodiment 510 includes six contiguous double-canopy panels 520 and two contiguous single-canopy panels 530. FIG. 5*b* shows a bottom view of the same fifth exemplary embodiment 510.

Figure 6A:
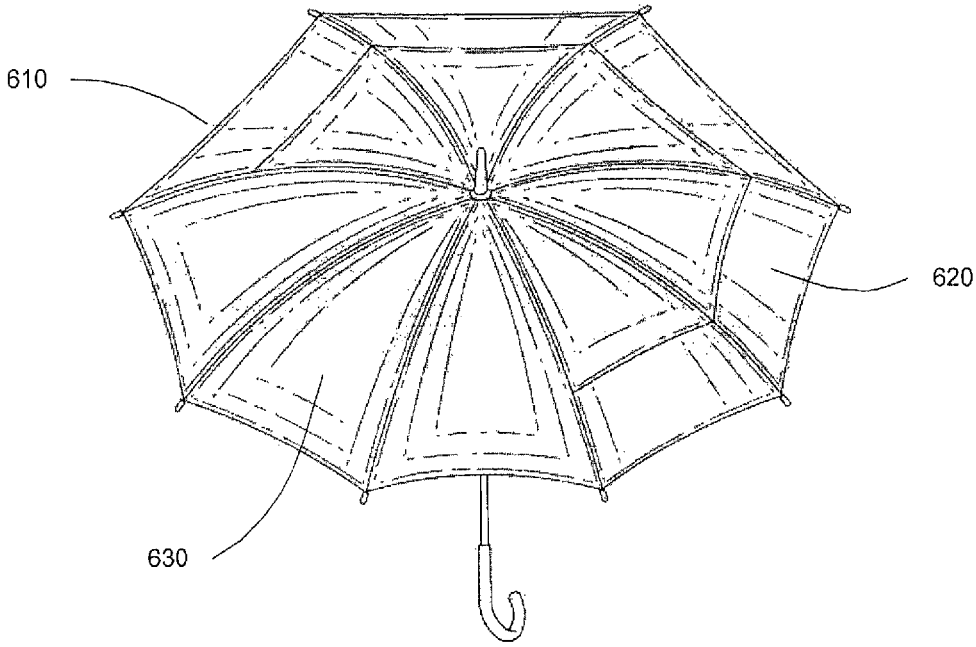
FIGS. 6*a* and 6*b* show top and bottom views of a sixth exemplary umbrella canopy according to the present invention.
Figure 6B:
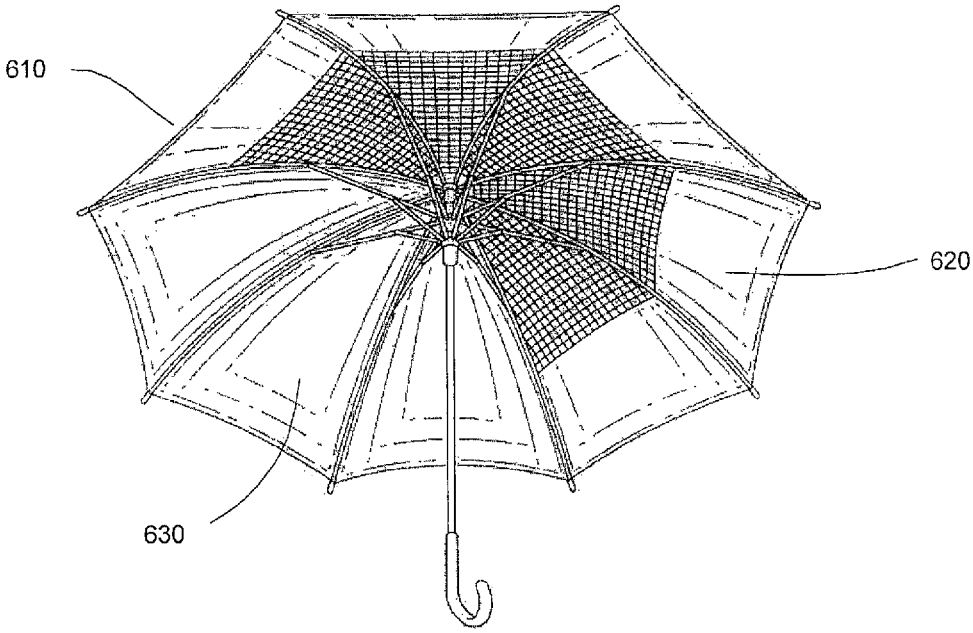

FIG. 6*a* illustrates a top view of a sixth exemplary embodiment 610 of an umbrella canopy according to the present invention. The sixth exemplary embodiment 610 includes five contiguous double-canopy panels 620 and three contiguous single-canopy panels 630. FIG. 6*b* shows a bottom view of the same sixth exemplary embodiment 610.

Figure 7A:
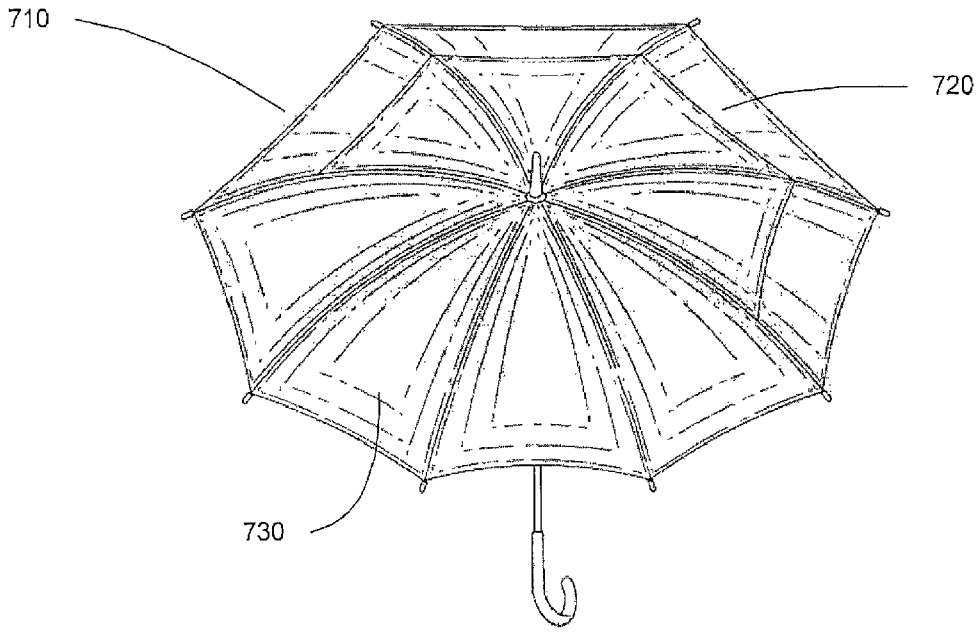
FIGS. 7*a* and 7*b* show top and bottom views of a seventh exemplary umbrella canopy according to the present invention.
Figure 7B:
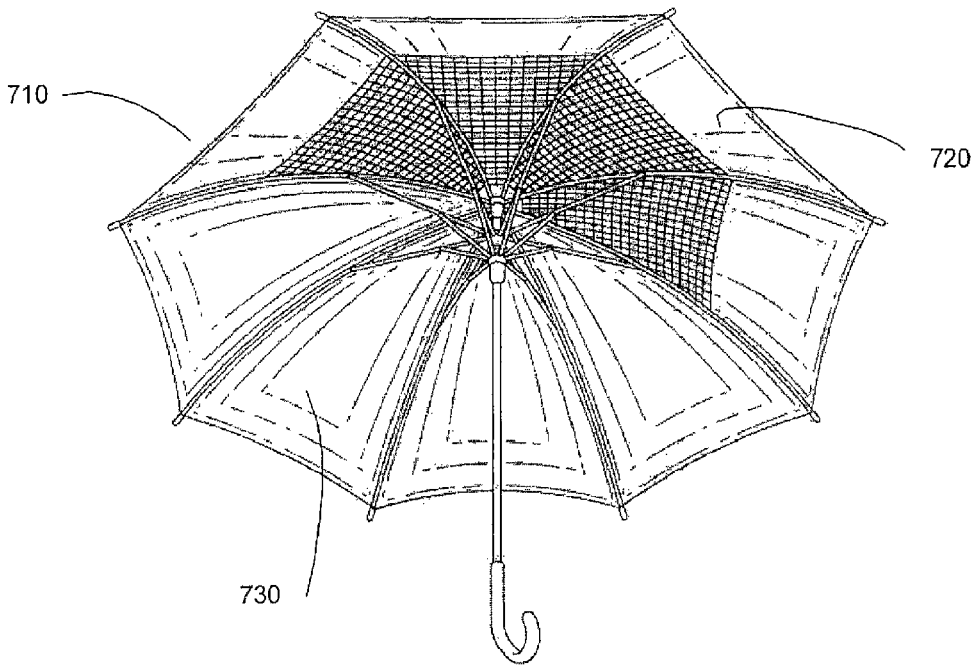

FIG. 7*a* illustrates a top view of a seventh exemplary embodiment 710 of an umbrella canopy according to the present invention. The seventh exemplary embodiment 710 includes four contiguous double-canopy panels 720 and four contiguous single-canopy panels 730. FIG. 7*b* shows a bottom view of the same seventh exemplary embodiment 710.

Figure 8A:
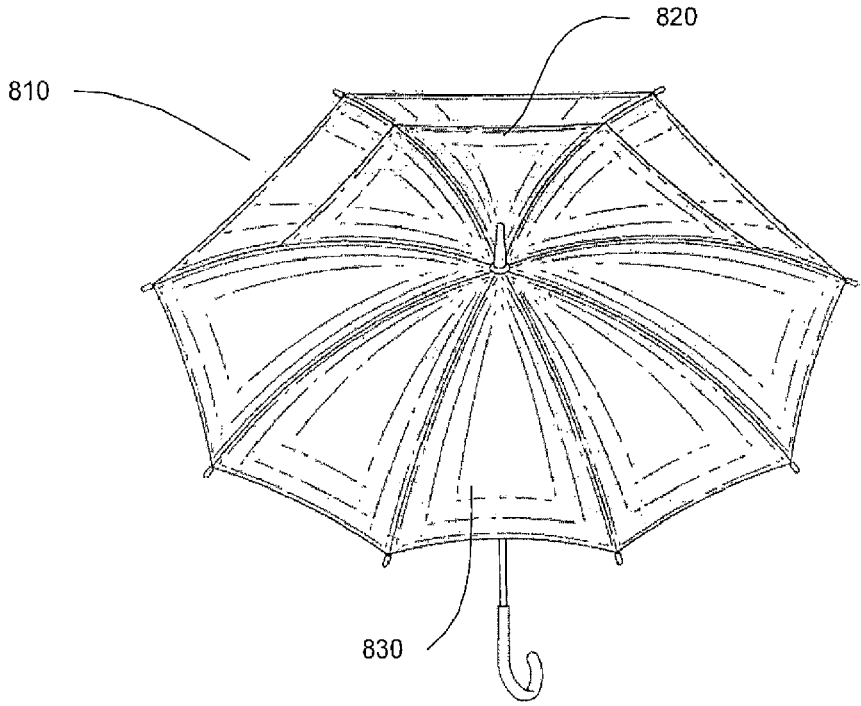
FIGS. 8*a* and 8*b* show top and bottom views of an eighth exemplary umbrella canopy according to the present invention.
Figure 8B:
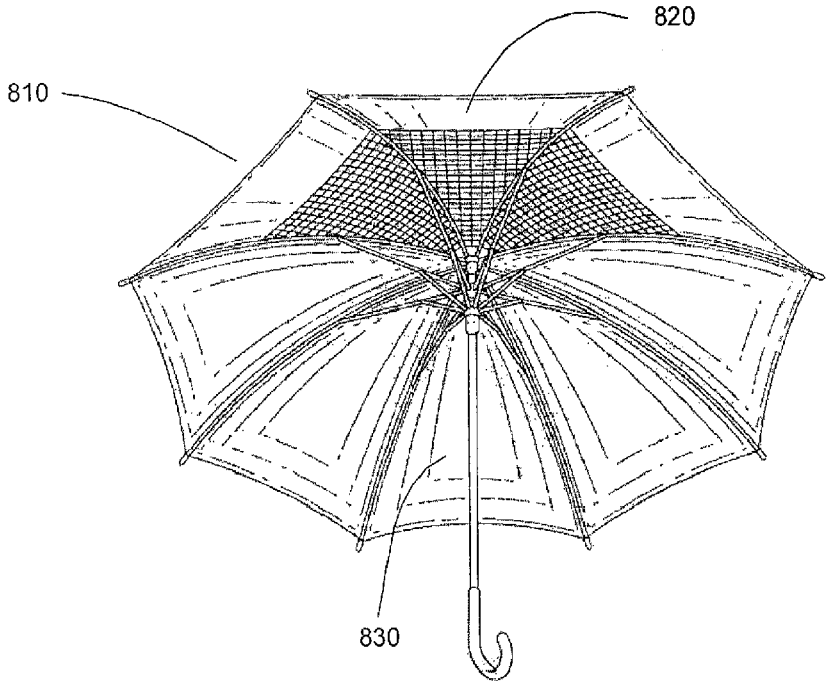

FIG. 8*a* illustrates a top view of an eighth exemplary embodiment 810 of an umbrella canopy according to the present invention. The eighth exemplary embodiment 810 includes three contiguous double-canopy panels 820 and five contiguous single-canopy panels 830. FIG. 8*b* shows a bottom view of the same eighth exemplary embodiment 810.

Figure 9A:
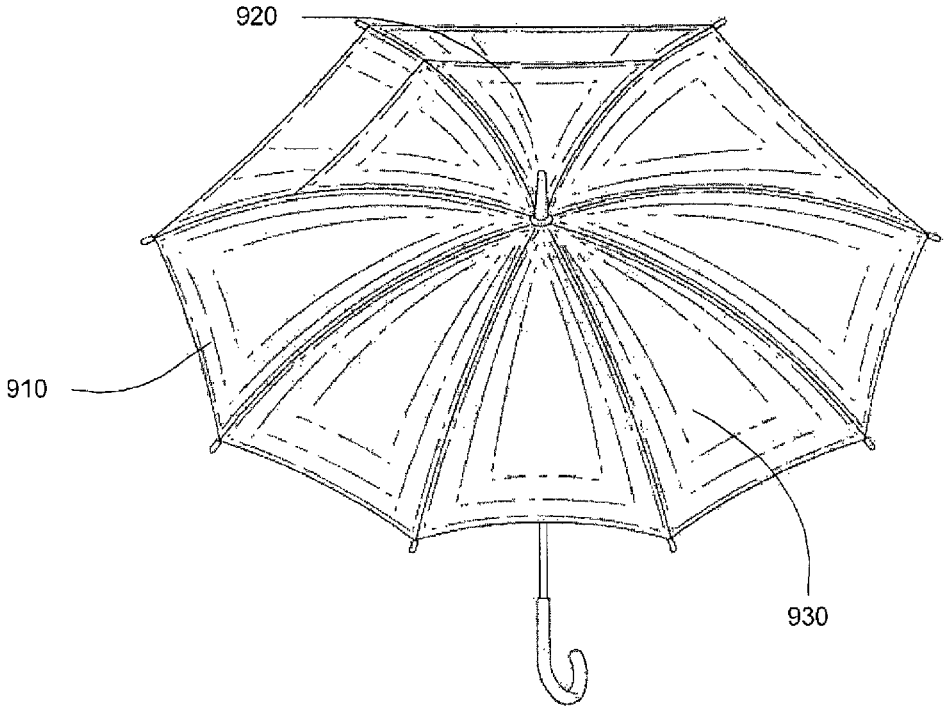
FIGS. 9*a* and 9*b* show top and bottom views of a ninth exemplary umbrella canopy according to the present invention.
Figure 9B:
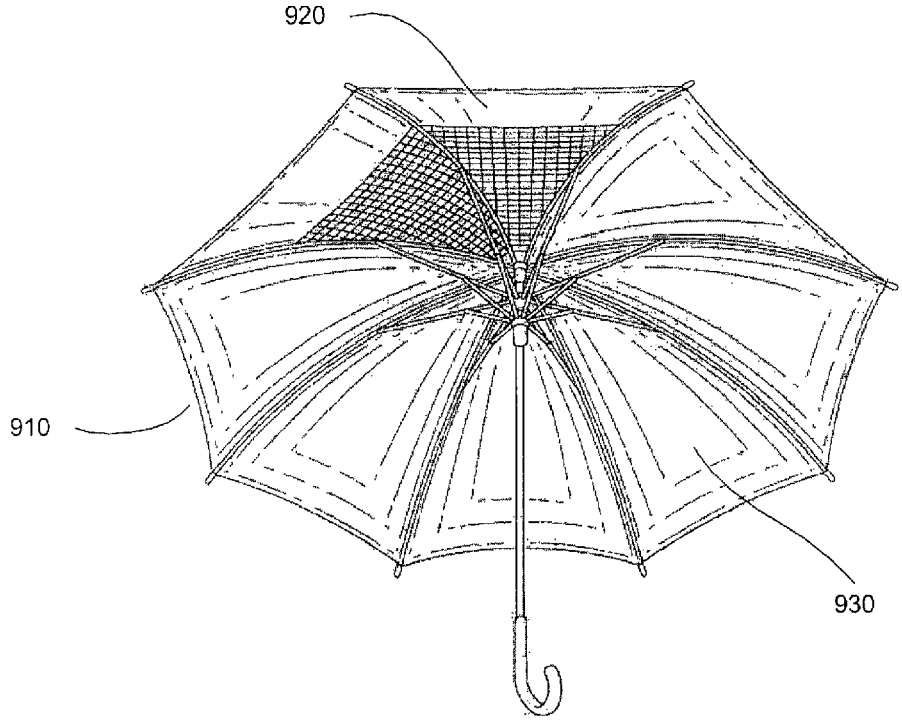

FIG. 9*a* illustrates a top view of a ninth exemplary embodiment 910 of an umbrella canopy according to the present invention. The ninth exemplary embodiment 910 includes two contiguous double-canopy panels 920 and six contiguous single-canopy panels 930. FIG. 9*b* shows a bottom view of the same ninth exemplary embodiment 910.

Figure 10A:
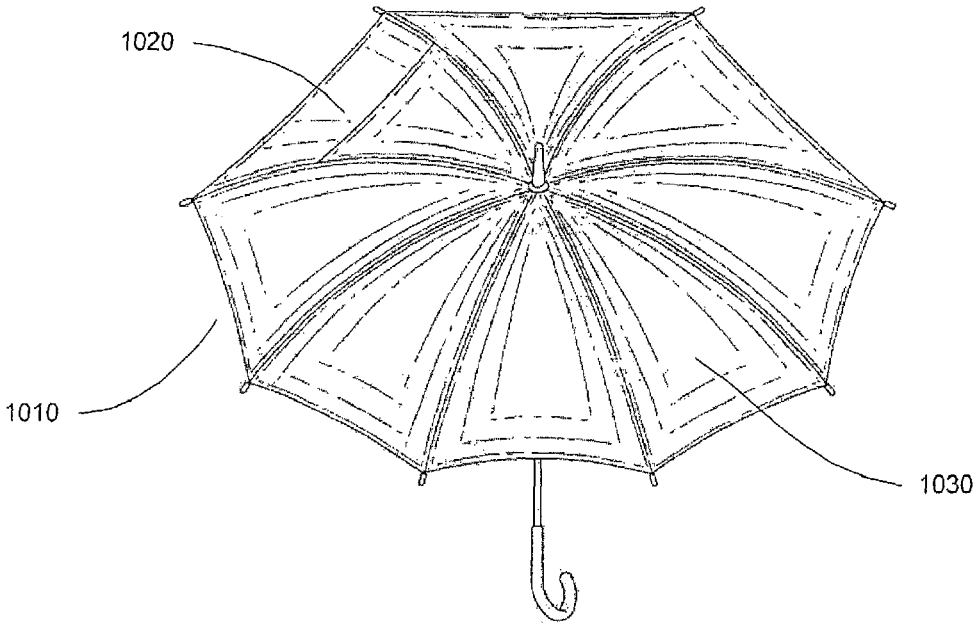
FIGS. 10*a* and 10*b* show top and bottom views of a tenth exemplary umbrella canopy according to the present invention.
Figure 10B:
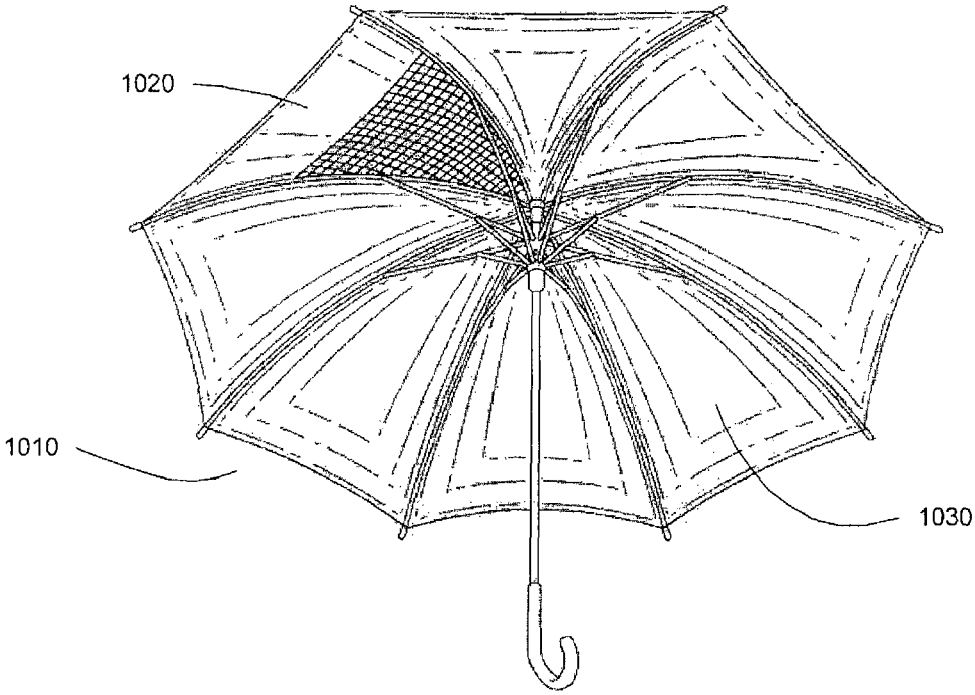

FIG. 10*a* illustrates a top view of a tenth exemplary embodiment 1010 of an umbrella canopy according to the present invention. The tenth exemplary embodiment 1010 includes one double-canopy panel 1020 and seven contiguous single-canopy panels 1030. FIG. 10*b* shows a bottom view of the same tenth exemplary embodiment 1010.

Figure 12:
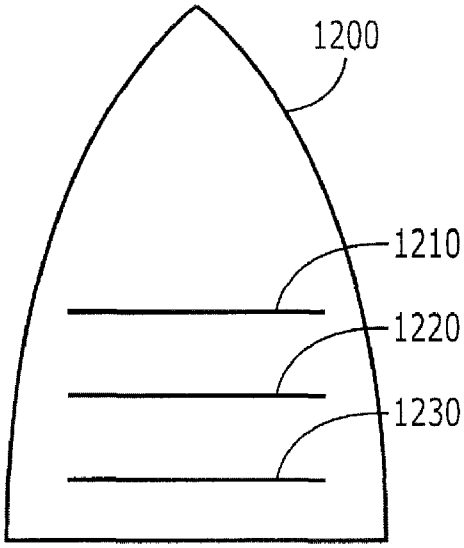
FIG. 12 shows a single exemplary air-transmissible panel having substantially linear slits for transmitting air.
Figure 13:
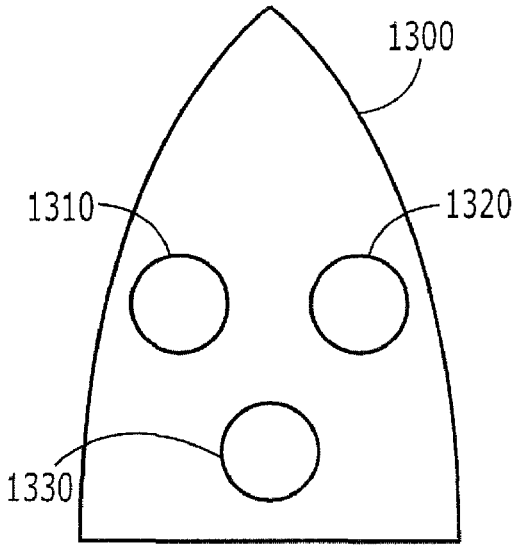
FIG. 13 shows a single exemplary air-transmissible panel having substantially circular shaped holes for transmitting air.
Figure 14:
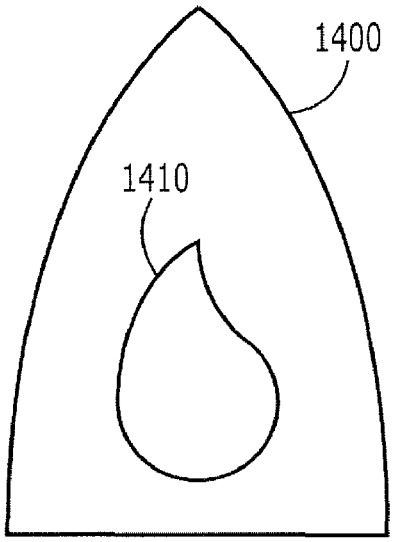
FIG. 14 shows a single exemplary air-transmissible panel having substantially teardrop shaped holes for transmitting air.
Figure 15:
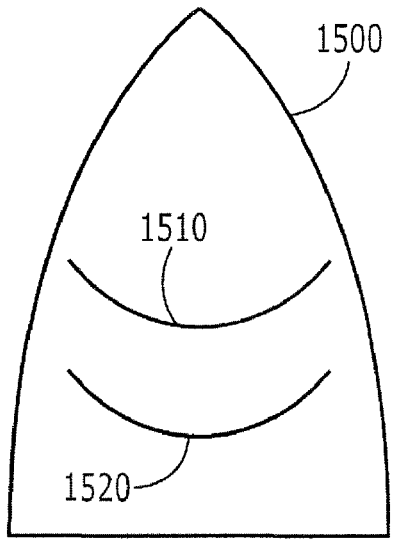
FIG. 15 shows a single exemplary air-transmissible panel having substantially curvilinear slits for transmitting air.

As described above, FIGS. 1-10*b* show the air transmissible panels as being constructed of a mesh material. However, FIGS. 12-15 show examples of other types of air transmissible panels that are constructed of an air-intransmissible material having vias or holes in the air-intransmissible material to allow air to be transmitted therethrough. FIG. 12 shows a single exemplary air-transmissible panel 1200 having substantially linear slits 1210-1230 for transmitting air. FIG. 13 shows a single exemplary air-transmissible pane 1300 having substantially circular shaped holes 1310-1330 for transmitting air. FIG. 14 shows a single exemplary air-transmissible panel 1400 having substantially teardrop shaped hole 1410 for transmitting air. FIG. 15 shows a single exemplary air-transmissible panel 1500 having substantially curvilinear slits 1510-1520 for transmitting air. Those skilled in the art will understand that other shapes are also possible.

It should be apparent to those of skill in the art that the specific configurations of single-canopy and double-canopy panels in the embodiments discussed above and illustrated in FIGS. 1*a* through 10*b* are only exemplary, and that other configurations incorporating both single-canopy and double-canopy panels are possible without departing from the broader spirit of the present invention.

It should also be apparent that while the bottom views in FIGS. 1*b* through 10*b* illustrate double-canopy panels reinforced with mesh, other means of reinforcing the double-canopy panels may be used without departing from the broader spirit of the present invention.

In the preceding specification, the present invention has been described with reference to specific exemplary embodiments thereof. It will, however, be evident that various modifications and changes may be made thereunto without departing from the broadest spirit and scope of the present invention as set forth in the claims that follow. The specification and drawings are accordingly to be regarded in an illustrative rather than restrictive sense.

What is claimed is:

1. An umbrella, comprising:

a central shaft a plurality of ribs secured to the central;

a plurality of double-canopy panels, wherein the double-canopy panels comprise an upper canopy panel and a lower canopy panel, the upper canopy panel being substantially triangular including an upper end, a lower edge and two radial edges, each of the radial edges intersecting with the lower edge at a corner of the upper canopy panel and, wherein the lower canopy panel is secured to at least one of the ribs in a plurality of locations and the upper canopy panel is only secured to the central shaft at the upper end and to the lower canopy panel at the corners of the upper canopy panel and the upper canopy is not secured to the rib.

2. The umbrella canopy of claim 1, wherein the lower canopy panel comprises a substantially air-intransmissible first portion and an air-transmissible second portion.

3. The umbrella canopy of claim 2, wherein the air-transmissible second portion comprises a mesh.

4. The umbrella canopy of claim 2, wherein the air-transmissible second portion comprises a substantially air-intransmissible material with one or more perforations to permit air transmissibility.

5. The umbrella canopy of claim 4, wherein the perforations are substantially linear slits.

6. The umbrella canopy of claim 4, wherein the perforations are substantially circular.

7. The umbrella canopy of claim 4, wherein the perforations are substantially teardrop-shaped.

8. The umbrella canopy of claim 4, wherein the perforations are substantially curvilinear slits.

9. The umbrella canopy of claim 2, wherein the air-intransmissible portions of the double-canopy panels comprise nylon.

10. The umbrella canopy of claim 1, wherein the canopy comprises a total of one of 6 panels, 8 panels, and 10 panels.

11. The umbrella canopy of claim 1, wherein the canopy comprises a material that receives screen printing.

12. An umbrella, comprising:

a central shaft adapted to be grasped by a user at a first end thereof and having a second end;

a spindle slidably disposed on the central shaft and movable between a first position adjacent to the first end of the central shaft and a second position adjacent to the second end of the central shaft;

a first plurality of radially extending ribs hingedly attached at first ends thereof to the second end of the central shaft and terminating at second ends;

a second plurality of radially extending ribs secured at first ends thereof hingedly to the spindle and secured at second ends thereof to respective ones of the first plurality of ribs; and an umbrella canopy supported by the first plurality of ribs, the canopy secured to the first ends of the first plurality of ribs adjacent to the second end of the central shaft and secured to the second ends of the second plurality of ribs at an outer perimeter of the canopy, wherein the canopy includes a plurality of double-canopy umbrella panels;

wherein the double-canopy umbrella panels includes an upper canopy panel and a lower canopy panel, the upper canopy panel being substantially triangular including an upper end, a lower edge and two radial edges, each of the radial edges intersecting with the lower edge at a corner of the upper canopy panel, and wherein the lower canopy panel is secured directly to the ribs and the upper canopy panel is only secured to the central shaft at the upper end and to the lower canopy panel at the corners of the upper canopy panel and the upper canopy panel is not secured to the rib.

13. The umbrella of claim 12, wherein the double-canopy panels comprise a substantially air-intransmissible first portion and an air-transmissible second portion.

14. The umbrella of claim 13, wherein the air-transmissible second portion comprises a mesh.

15. The umbrella of claim 13, wherein the air-transmissible second portion comprises a substantially air-intransmissible material with one or more perforations to permit air transmissibility.

16. The umbrella of claim 15, wherein the perforations are one of a substantially linear slit, a substantially circular hole, a substantially teardrop-shaped hole and a substantially curvilinear slit.

* * * * *